US011766878B2

(12) United States Patent
Sadakuni

(10) Patent No.: US 11,766,878 B2
(45) Date of Patent: Sep. 26, 2023

(54) POST-PROCESSING APPARATUS

(71) Applicant: Seiko Epson Corporation, Tokyo (JP)

(72) Inventor: Kei Sadakuni, Kiyosu (JP)

(73) Assignee: Seiko Epson Corporation, Tokyo (JP)

( * ) Notice: Subject to any disclaimer, the term of this patent is extended or adjusted under 35 U.S.C. 154(b) by 32 days.

(21) Appl. No.: 17/653,073

(22) Filed: Mar. 1, 2022

(65) Prior Publication Data

US 2022/0281235 A1 Sep. 8, 2022

(30) Foreign Application Priority Data

Mar. 4, 2021 (JP) ..... 2021-034807

(51) Int. Cl.
*B41J 11/00* (2006.01)

(52) U.S. Cl.
CPC ..... *B41J 11/0022* (2021.01)

(58) Field of Classification Search
None
See application file for complete search history.

(56) References Cited

U.S. PATENT DOCUMENTS

2012/0161379 A1* 6/2012 Matsui ..... B65H 31/36
270/58.17

FOREIGN PATENT DOCUMENTS

JP 2012-140202 7/2012

* cited by examiner

*Primary Examiner* — Bradley W Thies
(74) *Attorney, Agent, or Firm* — WORKMAN NYDEGGER

(57) ABSTRACT

The apparatus includes a first ejection unit, a processing tray, a blower unit, a control unit, and a post-processing unit. The first ejection unit ejects a medium recorded by ejection of a liquid. On the processing tray, the medium ejected by the first ejection unit is stacked. The blower unit blows air to the medium stacked on the processing tray. The control unit controls the blower unit. The post-processing unit post-processes the medium stacked on the processing tray. Based on processing information about processing performed on the medium, the control unit changes a blowing amount at which the blower unit blows air.

13 Claims, 7 Drawing Sheets

POST-PROCESSING APPARATUS

The present application is based on, and claims priority from JP Application Serial Number 2021-034807, filed Mar. 4, 2021, the disclosure of which is hereby incorporated by reference herein in its entirety.

BACKGROUND

1. Technical Field

Embodiments of the present disclosure relate to a post-processing apparatus.

2. Related Art

A post-processing apparatus of related art, for example, one disclosed in JP-A-2012-140202, performs post processing on paper that is an example of a medium on which an image has been formed. A post-processing apparatus includes a stacker, which is an example of a processing tray on which sheets of paper are stacked, a stopper, which is an example of an edge alignment unit, and a blower unit that blows air toward the stacker. The blower unit produces a layer of air between a sheet and another sheet, thereby making the sheet easier to move. A sheet becomes aligned by falling and abutting against the stopper.

The size of a curl and the flexibility of a medium could be affected by, for example, an image formed thereon. Therefore, depending on the state of sheets of a medium stacked on the processing tray, the buckling of the medium might occur.

SUMMARY

A post-processing apparatus according to a certain aspect of the present disclosure includes: an ejection unit that ejects a medium recorded by a recording unit configured to perform recording by ejecting a liquid; a processing tray on which the medium ejected by the ejection unit is stacked; a blower unit that blows air to the medium stacked on the processing tray; a control unit that controls the blower unit; and a post-processing unit that post-processes the medium stacked on the processing tray; wherein based on processing information about processing performed on the medium, the control unit changes a blowing amount at which the blower unit blows air.

A post-processing apparatus according to another aspect of the present disclosure includes: a first ejection unit that ejects a medium recorded by a recording unit configured to perform recording by ejecting a liquid; a processing tray on which the medium ejected by the first ejection unit is stacked; a post-processing unit that post-processes the medium on the processing tray; a second ejection unit that ejects the medium stacked on the processing tray; a blower unit that blows air to the medium ejected by the second ejection unit; a control unit that controls the blower unit; and a stacking tray on which the medium ejected by the second ejection unit is stacked; wherein based on processing information about processing performed on the medium, the control unit changes a blowing amount at which the blower unit blows air.

DESCRIPTION OF EXEMPLARY EMBODIMENTS

First Embodiment

Recording System

Figure 1:
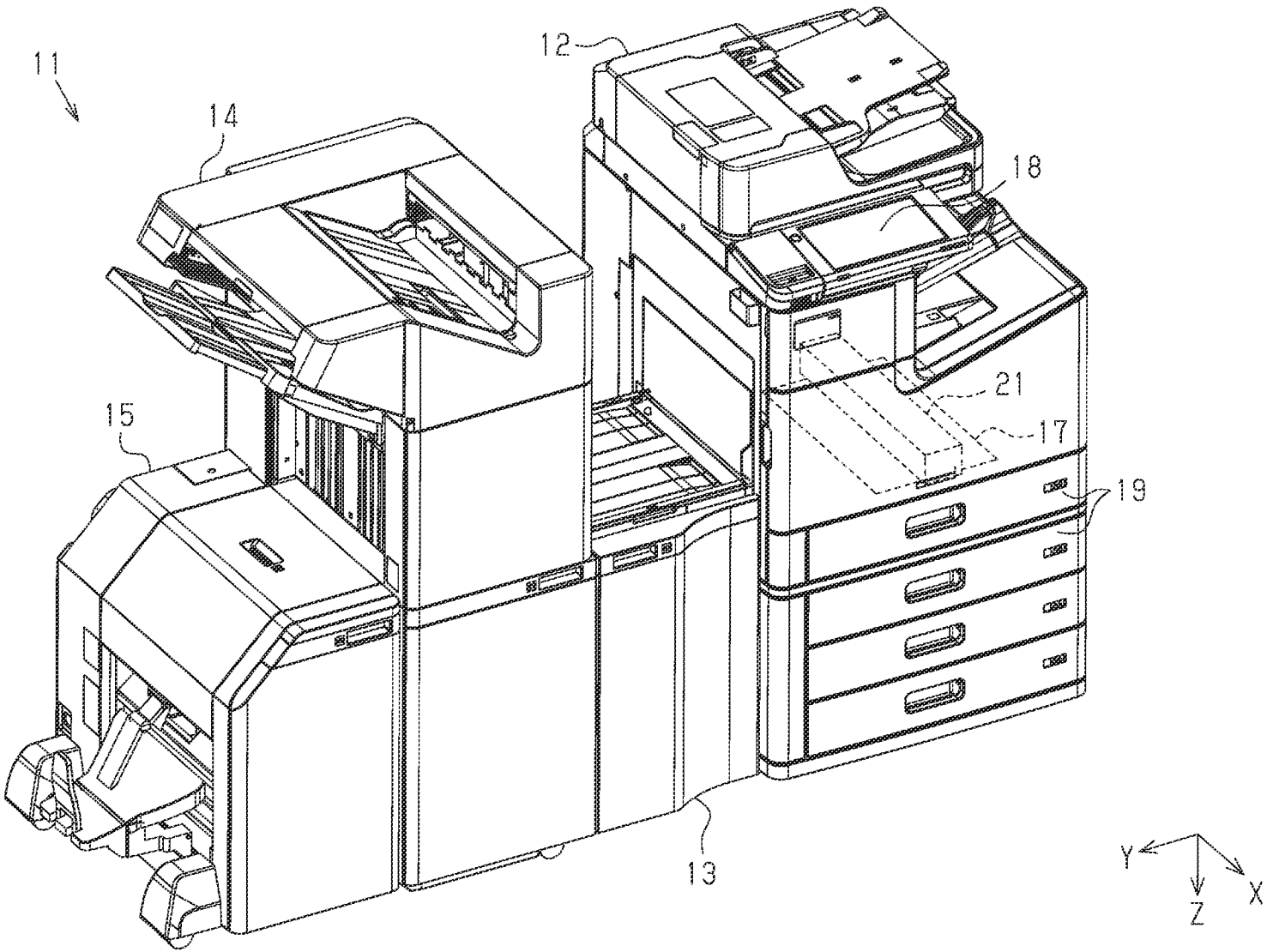
FIG. 1 is a perspective view of a recording system that includes a post-processing apparatus according to a first embodiment.

With reference to the accompanying drawings, a recording system that includes a post-processing apparatus according to a first embodiment will now be explained.

In the drawings, it is assumed that a recording system 11 is installed on a horizontal plane, and, based on this assumption, the direction of gravity is indicated by a Z axis, and the directions along the horizontal plane are indicated by an X axis and a Y axis. The X, Y, and Z axes are orthogonal to one another. In the description below, a direction that is parallel to the X axis will be referred to also as a width direction X, a direction that is parallel to the Y axis will be referred to also as a transportation direction Y, and a direction that is parallel to the Z axis will be referred to also as a vertical direction Z.

As illustrated in FIG. 1, the recording system 11 includes a recording apparatus 12, an intermediate apparatus 13, a post-processing apparatus 14, and a saddle folding apparatus 15, which are provided in a line in the transportation direction Y. The recording apparatus 12, the intermediate apparatus 13, the post-processing apparatus 14, and the saddle folding apparatus 15 are installed adjacent to one another.

The recording apparatus 12 is, for example, an ink-jet printer that prints an image by ejecting ink, which is an example of a liquid, onto a medium 17. The image is formed of liquid droplets having landed onto the surface of the medium 17. The image includes a photo, a pattern, a text, a mark, a line, a table, and the like.

The recording apparatus 12 may include an operation unit 18, for example, a touch panel, for operating the recording apparatus 12 and the recording system 11, and a medium containing unit 19, in which sheets of the medium 7 can be contained in a stacked state. The recording apparatus 12 may include a plurality of medium containers 19.

The recording apparatus 12 includes a recording unit 21 that performs recording by ejecting a liquid. The recording unit 21 performs recording on the medium 17 fed one sheet after another out of the medium containing unit 19. The recording unit 21 according to the present embodiment is a line-type unit provided throughout the entirety of the medium 17 in the width direction X. The recording unit 21 may be configured as a serial-type unit that performs recording while moving in the width direction X of the medium 17.

The recording apparatus 12 is capable of performing single-sided recording, in which printing is performed on one side only of the medium 17, and double-sided recording, in which printing is performed on both sides of the medium 17. When single-sided recording is performed, the recording apparatus 12 sends the medium 17 to the intermediate apparatus 13 after printing an image on the front of the medium 17. When double-sided recording is performed, after an image is printed on the front of the medium 17, the sheet of the medium 17 is turned over to be sent back to the recording apparatus 12. Then, the recording apparatus 12 prints an image on the back of the medium 17. After completion of recording on both sides, the recording apparatus 12 sends the medium 17 to the intermediate apparatus 13.

The intermediate apparatus 13 sends the medium 17, on which the single-sided recording or the double-sided recording has been performed, to the post-processing apparatus 14. If saddle folding, which is processing of folding the medium 17 after completion of recording into half, is to be performed, the post-processing apparatus 14 sends the medium 17 to the saddle folding apparatus 15. The saddle folding apparatus 15 may perform saddle stitching on the medium 17. Saddle stitching is processing of stapling sheets of the medium 17 together at the middle.

Post-Processing Apparatus

Figure 2:
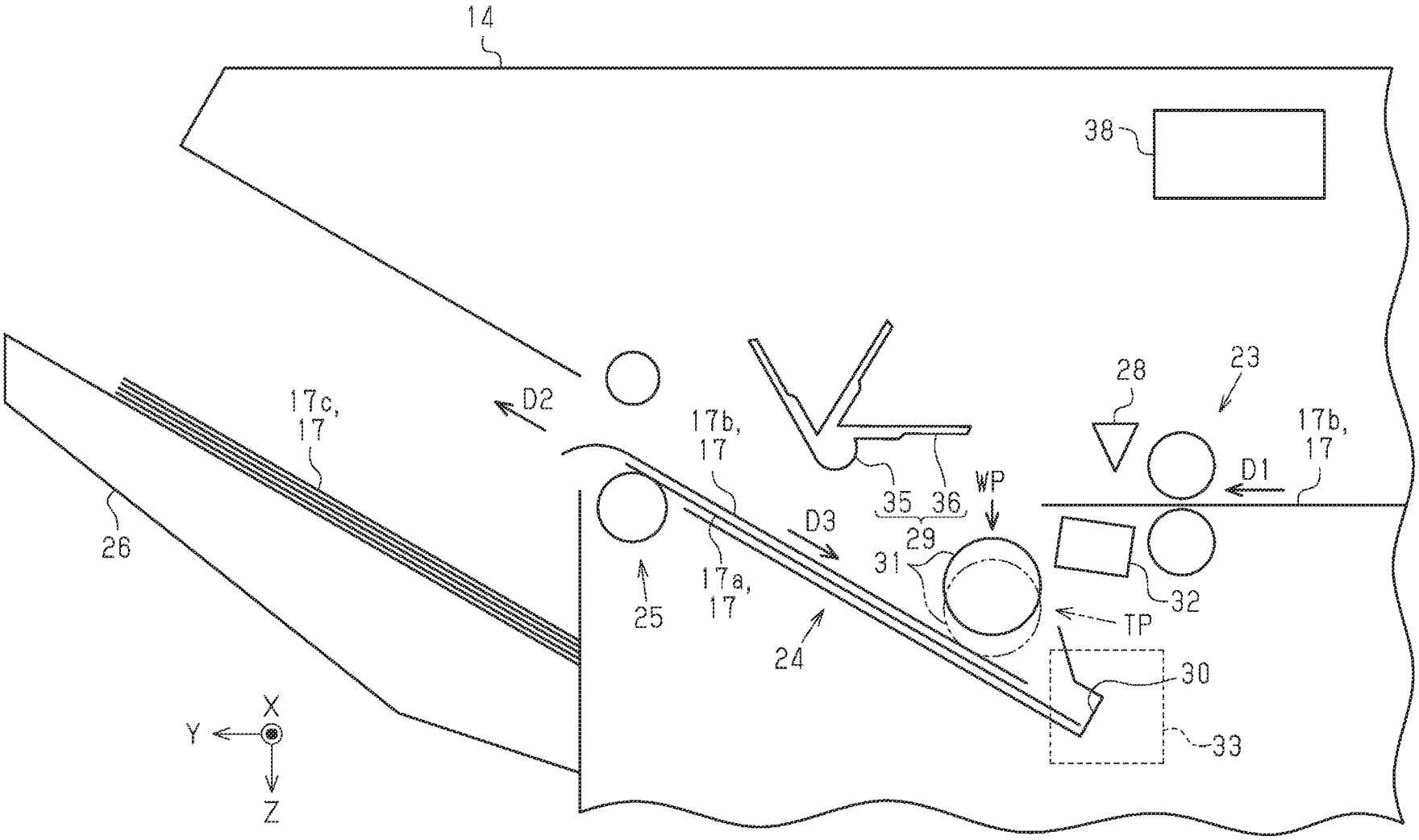
FIG. 2 is a schematic view of the post-processing apparatus.

As illustrated in FIG. 2, the post-processing apparatus 14 includes a first ejection unit 23 and a processing tray 24. The first ejection unit 23, which is an example of an ejection unit, ejects the medium 17 on which recording has been performed by the recording unit 21. Sheets of the medium 17 ejected by the first ejection unit 23 are stacked on the processing tray 24. The post-processing apparatus 14 may include a second ejection unit 25, which ejects sheets of the medium 17 stacked on the processing tray 24, and a stacking tray 26, on which the sheets of the medium 17 ejected by the second ejection unit 25 are stacked.

Each of the first ejection unit 23 and the second ejection unit 25 may be constituted of a pair of rollers. Each of the first ejection unit 23 and the second ejection unit 25 ejects the medium 17 by rotating in a state of nipping the medium 17 therebetween.

In the present embodiment, an already-aligned medium 17 on the processing tray 24 is referred to as a first medium 17*a*, a yet-to-be-aligned medium 17 ejected by the first ejection unit 23 is referred to as a second medium 17*b*, and a stack of the medium 17 on the stacking tray 26 is referred to as a third medium 17*c*. The second medium 17*b* is the medium 17 ejected by the first ejection unit 23 to the processing tray 24 next after the top sheet of the first medium 17*a* among the plurality of sheets of the first medium 17*a* stacked on the processing tray 24. The first ejection unit 23 ejects the second medium 17*b* in a first ejection direction D1. The second ejection unit 25 ejects the first medium 17*a* in a second ejection direction D2.

The processing tray 24 is located downstream of the first ejection unit 23 in the first ejection direction D1. In addition, at least a part of the processing tray 24 is located below the first ejection unit 23 in the vertical direction Z. Therefore, the processing tray 24 receives the second medium 17*b* ejected by and falling from the first ejection unit 23. Alignment of the second medium 17*b* is performed on the processing tray 24. As a result, the second medium 17*b* turns into the first medium 17*a*. That is, the second medium 17*b* ejected from the first ejection unit 23 is regarded as the first medium 17*a* by being stacked on the processing tray 24 and then undergoing alignment.

The stacking tray 26 is located downstream of the second ejection unit 25 in the second ejection direction D2. In addition, at least a part of the stacking tray 26 is located below the second ejection unit 25 in the vertical direction Z. Therefore, the stacking tray 26 receives the first medium 17*a* ejected by and falling from the second ejection unit 25. The third medium 17*c* on the stacking tray 26 receives the first medium 17*a* ejected by and falling from the second ejection unit 25. The first medium 17*a* is regarded as the third medium 17*c* by being stacked on the stacking tray 26.

The post-processing apparatus 14 may include a detection unit 28, which is capable of detecting the second medium 17*b*, a paddle 29, which is provided downstream of the first ejection unit 23 in the first ejection direction D1, an edge alignment unit 30, which is provided on the processing tray 24, and a transportation unit 31, which transports the medium 17 to the edge alignment unit 30. The post-processing apparatus 14 includes a blower unit 32, which blows air to sheets of the medium 17 stacked on the processing tray 24, and a post-processing unit 33, which post-processes the medium 17 on the processing tray 24.

The paddle 29 is located above the processing tray 24. The paddle 29 includes a rotation shaft 35 and at least one blade 36. In the present embodiment, the paddle 29 includes three blades 36. The blade 36 is, for example, an elastic plate-like member. The blade 36 rotates together with the rotation shaft 35.

The transportation unit 31 may be, for example, a knurled belt. A knurled belt has surface irregularities. Frictional force acting between a knurled belt and an object with which the knurled belt is in contact is higher than that of a belt having a flat surface.

The transportation unit 31 is provided in such a way as to be able to move relatively in relation to the processing tray 24. The transportation unit 31 according to the present embodiment is able to move between a transportation position TP, which is indicated by a dot-dot-dash-line illustration in FIG. 2, and a waiting position WP, which is indicated by a solid-line illustration in FIG. 2.

The transportation position TP is a position where the transportation unit 31 is able to transport the second medium 17*b*. The transportation unit 31, when located at the transportation position TP, is in contact with the second medium 17*b* and nips the first medium 17*a* and the second medium 17*b* between itself and the processing tray 24. When there is no first medium 17*a* on the processing tray 24, the transportation unit 31 nips the second medium 17*b* between itself and the processing tray 24.

The transportation unit 31, when located at the transportation position TP, transports the second medium 17*b* in an alignment direction D3 by rotating counterclockwise in FIG. 2. The alignment direction D3 is a direction parallel to the surface of the processing tray 24 on which sheets of the first medium 17*a* are stacked. The edge alignment unit 30 is located at the downstream end of the processing tray 24 in the alignment direction D3. The transportation unit 31 brings the second medium 17*b* into contact with and abutment against the edge alignment unit 30 for alignment.

In other words, the edge alignment unit 30 aligns the edge of the second medium 17*b* transported by the transportation unit 31. The alignment according to the present embodiment means an operation of positioning the downstream edge of the second medium 17*b* in the alignment direction D3 in line with the edge alignment unit 30. When there is the first medium 17*a* on the processing tray 24, performing the alignment of the second medium 17*b* lines up the edge of the second medium 17*b* with the edge of the first medium 17*a*. Since the second medium 17*b* after the alignment is regarded as the first medium 17*a*, plural sheets of the first medium 17*a* are stacked on the processing tray 24 in a state in which the downstream edges of them in the alignment direction D3 have been lined up.

The waiting position WP is a position that is more distant from the processing tray 24 than the transportation position TP is. The waiting position WP is located over the transportation position TP. The transportation unit 31, when located at the waiting position WP, is away from the first medium 17*a* and thus makes the first medium 17*a* free.

The post-processing apparatus 14 according to the present embodiment performs staple processing on the first medium 17*a*. Staple processing is processing of binding plural sheets of the first medium 17*a* together with a staple. The post-processing apparatus 14 may perform punch processing, shift processing, or the like. Punch processing is processing of punching a hole through a single sheet or multiple sheets of the first medium 17*a*. Shift processing is processing of ejecting each set constituted of multiple sheets of the first medium 17*a*, one set after another, to the stacking tray 26 while shifting the respective positions of the sets from one another.

The post-processing apparatus 14 includes a control unit 38. The control unit 38 may perform overall control for the driving of each mechanism in the post-processing apparatus 14 centrally and control various operations performed by the post-processing apparatus 14. The control unit 38 can be configured as circuitry that includes α: one or more processors that perform various kinds of processing in accordance with a computer program; β: one or more dedicated hardware circuits such as an application specific integrated circuit configured to perform at least a part of various kinds of processing; or γ: a combination of them. The processor includes a CPU and memories such as a RAM and a ROM, etc. A program code or instruction for causing the CPU to execute processing is stored in the memory. The memory, that is, a computer-readable medium, includes every kind of readable medium accessible by a general-purpose or dedicated computer.

By controlling the blower unit 32, the control unit 38 changes a blowing amount at which air is blown. Specifically, based on processing information about processing performed on the medium 17, the control unit 38 changes the blowing amount at which air is blown.

Processing Information

Processing information may include recording density in recording processing performed by the recording unit 21 on the medium 17. The recording density is the ratio of an area where an image is printed to the area of the medium 17. In other words, the recording density is the ratio of the actual number of ink dots formed actually on the medium 17 to the maximum number of ink dots that can be formed thereon. The processing information may include the recording density of the upper surface and the recording density of the lower surface of each medium 17 individually. The processing information may include a value calculated from the recording density.

The processing information may include at least one of the following recording densities: a first upper-surface recording density, which is the recording density of the upper surface of the first medium 17*a*, a first lower-surface recording density, which is the recording density of the lower surface of the first medium 17*a*, a second upper-surface recording density, which is the recording density of the upper surface of the second medium 17*b*, a second lower-surface recording density, which is the recording density of the lower surface of the second medium 17*b*, a third upper-surface recording density, which is the recording density of the upper surface of the third medium 17*c*, and a third lower-surface recording density, which is the recording density of the lower surface of the third medium 17*c*. The processing information may include values calculated from these recording densities.

For example, the processing information may include a first sum that is a sum of the first upper-surface recording density and the second lower-surface recording density. When plural sheets are stacked on the processing tray 24, the first sum is a value calculated by adding together the first upper-surface recording density of the top one of these sheets of the first medium 17*a* and the second lower-surface recording density of the second medium 17*b* that is ejected next after this top sheet of the first medium 17*a*.

The processing information may include a third sum that is a sum of the third upper-surface recording density and the first lower-surface recording density. When plural sheets of the third medium 17*c* are stacked on the stacking tray 26 and when the second ejection unit 25 ejects plural sheets of the first medium 17*a* together, the third sum is a value calculated by adding together the third upper-surface recording density of the top one of these sheets of the third medium 17*c* and the first lower-surface recording density of the bottom one of these sheets of the first medium 17*a*.

The first ejection unit 23 according to the present embodiment ejects the second medium 17*b* on one side only of which recording has been performed, with the recorded side facing down. The second ejection unit 25 ejects the first medium 17*a*, with the recorded side facing down. Therefore, the lower surface of the first medium 17*a*, the second medium 17*b*, and the third medium 17*c* having undergone single-sided recording is the recorded side, and the upper surface thereof is the non-recorded side. The first upper-surface recording density, the second upper-surface recording density, and the third upper-surface recording density of the medium 17 having undergone single-sided recording is 0%.

The processing information may include the number of sheets of the first medium 17*a* ejected together by the second ejection unit 25. The post-processing unit 33 according to the present embodiment post-processes a processing-specified number of sheets of the first medium 17*a* stacked on the processing tray 24. Then, the second ejection unit 25 ejects these post-processed sheets of the first medium 17*a* together. Therefore, the number of sheets of the first medium 17*a* is an example of information about post processing performed on the first medium 17*a*.

The processing information may include first transportation time that is time from performing recording on the second medium 17*b* by the recording unit 21 to ejecting the second medium 17*b* by the first ejection unit 23. The first transportation time is the time taken for transporting the second medium 17*b* on which recording has been performed to the first ejection unit 23.

The processing information may include second transportation time that is time from performing recording on the first medium 17*a* by the recording unit 21 to ejecting the first medium 17*a* by the second ejection unit 25. The second transportation time according to the present embodiment is the time from completion of recording on the bottom sheet of the first medium 17*a* among the plurality of sheets of the first medium 17*a* stacked on the processing tray 24 to ejecting these sheets of the first medium 17*a*, including this bottom one, by the second ejection unit 25 together. In other words, the second transportation time is the time taken for a series of processes including transporting the second medium 17*b* on which recording has been performed to the first ejection unit 23, ejecting the second medium 17*b* from the first ejection unit 23, performing alignment and post processing, and finally ejecting the post-processed sheets from the second ejection unit 25.

The processing information may include humidity information about humidity. For example, the humidity information is the ratio of an amount of water vapor contained in air to an amount of saturated water vapor. An amount of saturated water vapor varies depending on temperature. Therefore, the processing information may include temperature information about the ambient temperature of the site where the post-processing apparatus 14 is installed. The amount of saturated water vapor is larger when the temperature is high than when the temperature is low. The amount of water vapor is larger when the humidity is high than when the humidity is low. Therefore, the amount of water vapor contained in air is larger when the temperature and the humidity are high than when the temperature and the humidity are low.

The post-processing apparatus 14 may include a non-illustrated measuring instrument capable of measuring either temperature or humidity, or both. The measuring instrument may be provided separately from the post-processing apparatus 14. The temperature information and the humidity information may be configured to be able to be inputted by operating the operation unit 18. The control unit 38 may acquire the temperature information and the humidity information from the measuring instrument, the operation unit 18, or an external apparatus such as a server.

Alignment Routine

With reference to the flowchart of FIG. 3, an alignment routine will now be explained. The alignment routine is executed at the timing of an input of a recording instruction that involves post processing. A second transportation threshold value used for comparison in the alignment routine has been set in advance based on, for example, the result of an experiment.

In a step S101, the control unit 38 acquires processing information. Specifically, the control unit 38 acquires the following data included in the processing information: the second upper-surface recording density, the second lower-surface recording density, the first sum, the third sum, the number of sheets stacked, humidity, temperature, the first transportation time, and the second transportation time.

Figure 4:
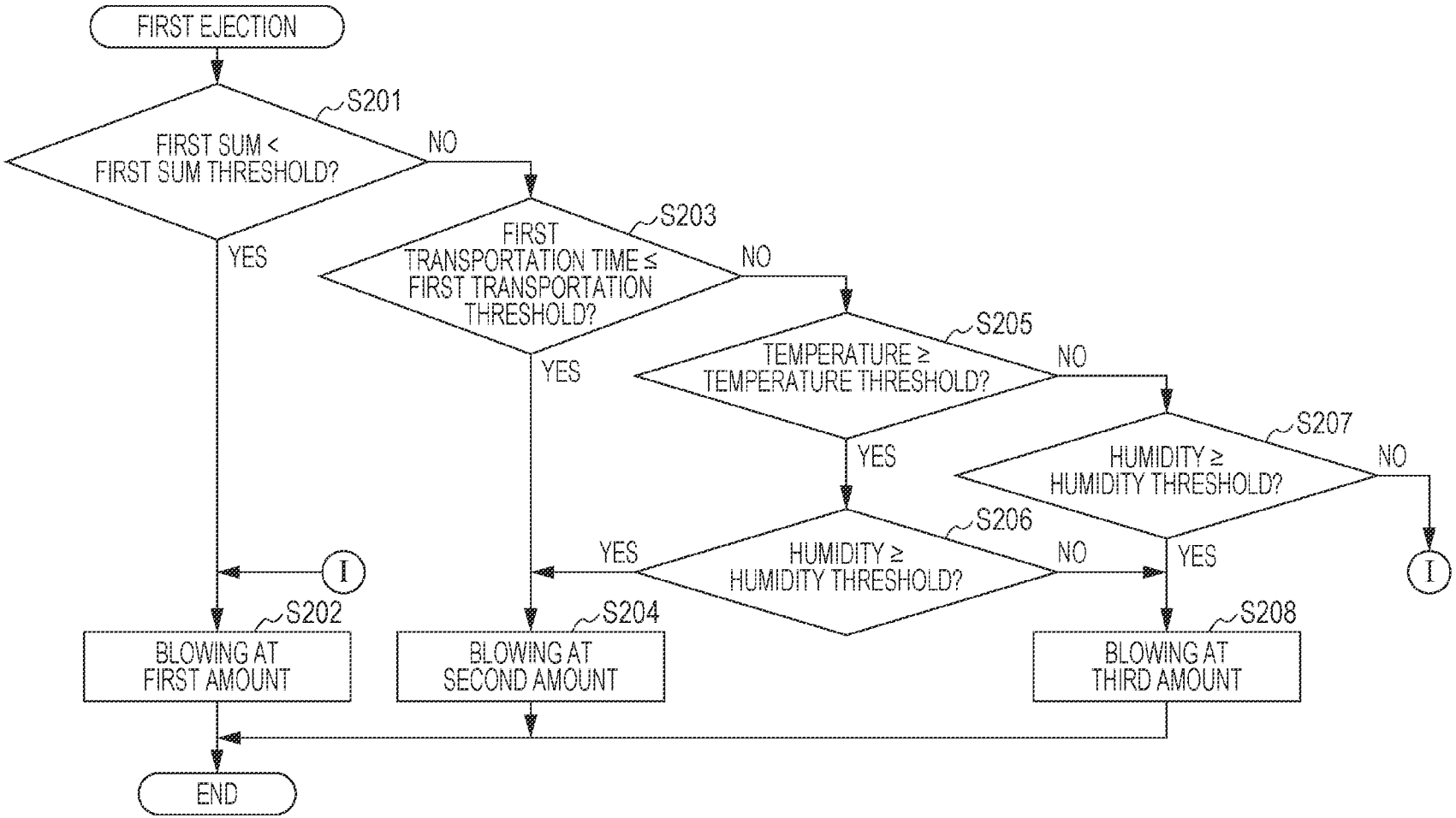
FIG. 4 is a flowchart that illustrates a first ejection sub-routine executed in the alignment routine.

In a step S102, the control unit 38 executes a first ejection sub-routine illustrated in FIG. 4. In a step S103, the control unit 38 causes the transportation unit 31 to rotate so as to align the second medium 17*b*. In the present embodiment, the medium 17 before alignment is referred to as the second medium 17*b*, and the medium 17 after alignment is referred to as the first medium 17*a*.

In a step S104, the control unit 38 determines whether the number of sheets of the first medium 17*a* stacked on the processing tray 24 has now reached the processing-specified number of sheets, which is the number of sheets having been specified as a unit of post-processing execution, or not. If the number of sheets stacked thereon has reached the processing-specified number of sheets, the determination result of the step S104 is YES. In this case, the control unit 38 advances the process to a step S105. In the step S105, the control unit 38 causes the post-processing unit 33 to post-process the plurality of sheets of the first medium 17*a* stacked on the processing tray 24. In a step S106, the control unit 38 executes a second ejection sub-routine illustrated in FIG. 5.

In a step S107, the control unit 38 determines whether the recording has finished or not. If there is any second medium 17*b* that has not been ejected from the first ejection unit 23 yet, the determination result of the step S107 is NO. In this case, the control unit 38 returns the process to the step S101. If every recorded sheet of the medium 17 has been transported to the stacking tray 26, the determination result of the step S107 is YES. In this case, the control unit 38 ends the alignment routine.

Referring back to the step S104, if the number of sheets stacked thereon has not yet reached the processing-specified number of sheets, the determination result of the step S104 is NO. In this case, the control unit 38 advances the process to a step S108. In the step S108, the control unit 38 compares the first transportation time with the second transportation threshold value. If the value of the first transportation time is equal to or greater than the second transportation threshold value, the determination result of the step S108 is YES. In this case, the control unit 38 advances the process to a step S109. In the step S109, the control unit 38 causes the blower unit 32 to blow air.

In the step S108, if the value of the first transportation time is less than the second transportation threshold value, the determination result of the step S108 is NO. In this case, the control unit 38 returns the process to the step S101. In the step S101, the control unit 38 acquires processing information. That is, the control unit 38 acquires the first upper-surface recording density and the first lower-surface recording density of the first medium 17*a* anew, which were the second upper-surface recording density and the second lower-surface recording density of the second medium 17*b* in the preceding sequence of the looped process.

First Ejection Sub-Routine

With reference to the flowchart of FIG. 4, the first ejection sub-routine will now be explained. Each of a first sum threshold value, a first transportation threshold value, a temperature threshold value, and a humidity threshold value that are used for comparison in the first ejection sub-routine has been set in advance based on, for example, the result of an experiment.

In a step S201, the control unit 38 compares the first sum, which is a sum of the first upper-surface recording density and the second lower-surface recording density, with the first sum threshold value. If the first sum is less than the first sum threshold value, the determination result of the step S201 is YES. In this case, the control unit 38 advances the process to a step S202. In the step S202, the control unit 38 controls the blower unit 32 and causes it to blow air at a first amount of blow.

In the step S201, if the first sum is equal to or greater than the first sum threshold value, the determination result of the step S201 is NO. In this case, the control unit 38 advances the process to a step S203. In the step S203, the control unit 38 compares the first transportation time with the first transportation threshold value. The first transportation threshold value is less than the second transportation threshold value. If the value of the first transportation time is equal to or less than the first transportation threshold value, the determination result of the step S203 is YES. In this case, the control unit 38 advances the process to a step S204. In the step S204, the control unit 38 controls the blower unit 32 and causes it to blow air at a second amount of blow that is larger than the first amount of blow.

In the step S203, if the value of the first transportation time is greater than the first transportation threshold value, the determination result of the step S203 is NO. In this case, the control unit 38 advances the process to a step S205. In the step S205, the control unit 38 compares the temperature with the temperature threshold value. If the value of the temperature is equal to or greater than the temperature threshold value, the determination result of the step S205 is YES. In this case, the control unit 38 advances the process to a step S206. If the value of the temperature is less than the temperature threshold value, the determination result of the step S205 is NO. In this case, the control unit 38 advances the process to a step S207.

Processing performed by the control unit 38 in the step S206 and processing performed by the control unit 38 in the step S207 are the same as each other. Specifically, in the step S206 and the step S207, the control unit 38 compares the humidity with the humidity threshold value.

If the value of the temperature is equal to or greater than the temperature threshold value and further if the value of the humidity is equal to or greater than the humidity threshold value, both of the determination result of the step S205 and the determination result of the step S206 are YES. In this case, the control unit 38 advances the process to the step S204.

If the value of the temperature is equal to or greater than the temperature threshold value and further if the value of the humidity is less than the humidity threshold value, the determination result of the step S205 is YES, and the determination result of the step S206 is NO. In this case, the control unit 38 advances the process to a step S208. In the step S208, the control unit 38 controls the blower unit 32 and causes it to blow air at a third amount of blow. The third amount is larger than the first amount and is smaller than the second amount.

If the value of the temperature is less than the temperature threshold value and further if the value of the humidity is equal to or greater than the humidity threshold value, the determination result of the step S205 is NO, and the determination result of the step S207 is YES. In this case, the control unit 38 advances the process to the step S208.

If the value of the temperature is less than the temperature threshold value and further if the value of the humidity is less than the humidity threshold value, both of the determination result of the step S205 and the determination result of the step S207 are NO. In this case, the control unit 38 advances the process to the step S202.

In the step S202, S204, or S208, the control unit 38 controls the blower unit 32 and causes it to blow air at the set blowing amount. Then, the control unit 38 ends the first ejection sub-routine.

Second Ejection Sub-Routine

Figure 5:
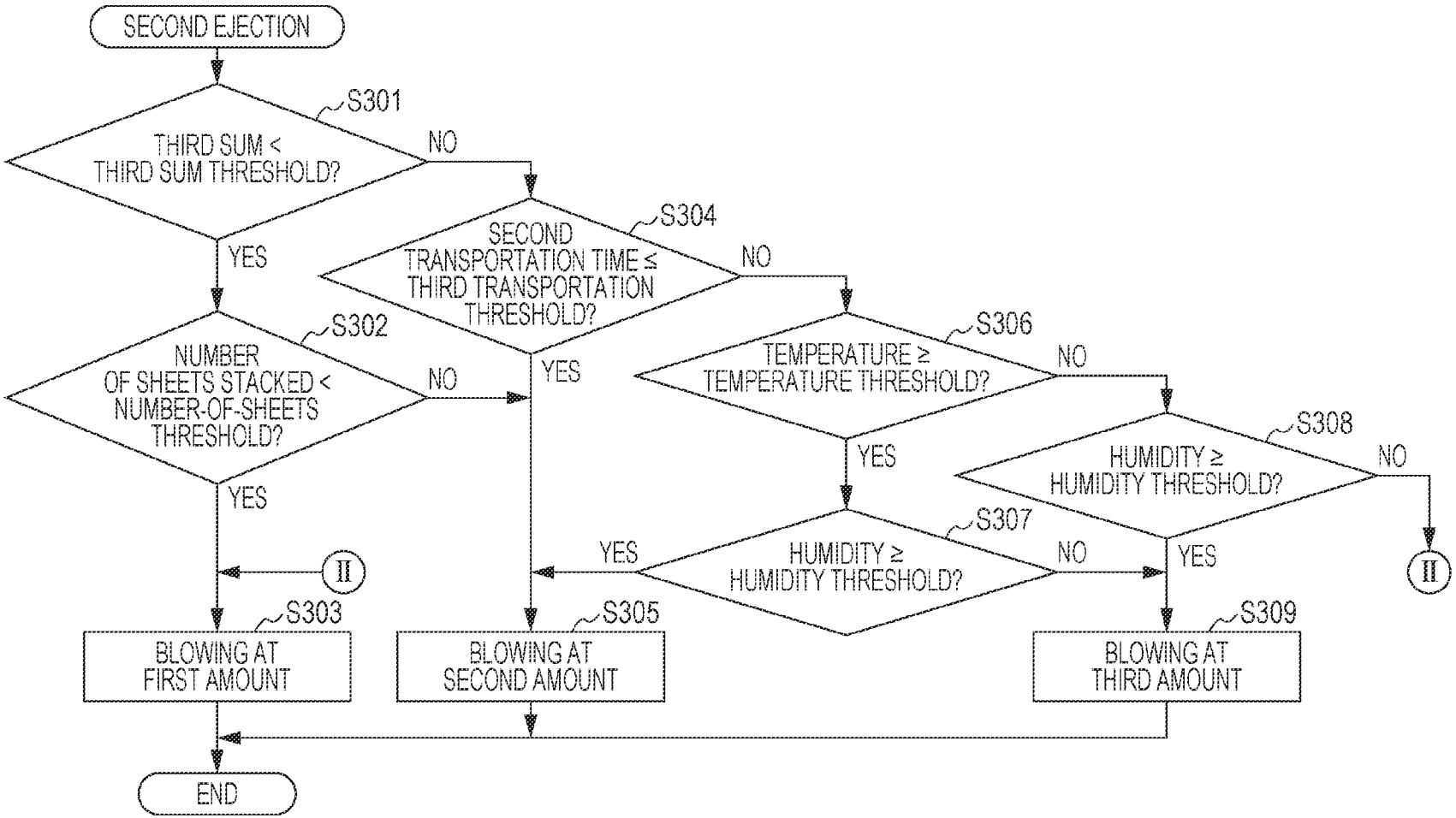
FIG. 5 is a flowchart that illustrates a second ejection sub-routine executed in the alignment routine.

With reference to the flowchart of FIG. 5, the second ejection sub-routine will now be explained. Each of a third sum threshold value, a number-of-sheets threshold value, a third transportation threshold value, a temperature threshold value, and a humidity threshold value that are used for comparison in the second ejection sub-routine has been set in advance based on, for example, the result of an experiment. A temperature threshold value that is different from the temperature threshold value used in the first ejection sub-routine may be set for the second ejection sub-routine. The temperature threshold value used in the second ejection sub-routine may be the same as the temperature threshold value used in the first ejection sub-routine. A humidity threshold value that is different from the humidity threshold value used in the first ejection sub-routine may be set for the second ejection sub-routine. The humidity threshold value used in the second ejection sub-routine may be the same as the humidity threshold value used in the first ejection sub-routine.

In a step S301, the control unit 38 compares the third sum, which is a sum of the third upper-surface recording density and the first lower-surface recording density, with the third sum threshold value. If the third sum is less than the third sum threshold value, the determination result of the step S301 is YES. In this case, the control unit 38 advances the process to a step S302.

In the step S302, the control unit 38 compares the number of sheets of the first medium 17*a* stacked on the processing tray 24 with the number-of-sheets threshold value. If the number of sheets stacked thereon is less than the number-of-sheets threshold value, the determination result of the step S302 is YES. In this case, the control unit 38 advances the process to a step S303. In the step S303, the control unit 38 controls the blower unit 32 and causes it to blow air at a first amount of blow. If the number of sheets stacked thereon is equal to or greater than the number-of-sheets threshold value, the determination result of the step S302 is NO. In this case, the control unit 38 advances the process to a step S305.

In the step S301, if the third sum is equal to or greater than the third sum threshold value, the determination result of the step S301 is NO. In this case, the control unit 38 advances the process to a step S304. In the step S304, the control unit 38 compares the second transportation time with the third transportation threshold value. The third transportation threshold value is greater than the first transportation threshold value and the second transportation threshold value. If the value of the second transportation time is equal to or less than the third transportation threshold value, the determination result of the step S304 is YES. In this case, the control unit 38 advances the process to a step S305. In the step S305, the control unit 38 controls the blower unit 32 and causes it to blow air at a second amount of blow that is larger than the first amount of blow.

In the step S304, if the value of the second transportation time is greater than the third transportation threshold value, the determination result of the step S304 is NO. In this case, the control unit 38 advances the process to a step S306.

The steps S306 to S309 are the same as the steps S205 to S208 illustrated in FIG. 4. Therefore, an explanation of these steps is omitted here.

Operation of First Embodiment

As illustrated in FIG. 2, the control unit 38 may keep the paddle 29 stopped in a stopped positional state illustrated in FIG. 2 while the first ejection unit 23 emits the second medium 17*b*. When the paddle 29 is in this state, the control unit 38 causes the blower unit 32 to blow air at a blowing amount that is suited for the state of the first medium 17*a* and the second medium 17*b*.

Specifically, if the first sum calculated by adding together the first upper-surface recording density of the upper surface of the first medium 17*a*, and the second lower-surface recording density of the lower surface of the second medium 17*b*, is less than the first sum threshold value, the control unit 38 sets the blowing amount into the first amount. If the first sum is equal to or greater than the first sum threshold value, the control unit 38 sets the blowing amount into the second amount that is larger than the first amount.

The control unit 38 may change the blowing amount in accordance with the length of the first transportation time from performing recording on the second medium 17*b* by the recording unit 21 to ejecting this recording-completed second medium 17*b* by the first ejection unit 23. If the first transportation time is long, the drying of the first medium 17*a* and the second medium 17*b* progresses while the second medium 17*b* is transported for ejection, and, because of this drying, frictional force that acts between the first medium 17*a* and the second medium 17*b* decreases in some instances. Therefore, the control unit 38 may cause the blower unit 32 to blow air at the second amount when the value of the first transportation time is equal to or less than the first transportation threshold value and may cause the blower unit 32 to blow air at the first amount or at the third amount when the value of the first transportation time is greater than the first transportation threshold value. The third amount is larger than the first amount and is smaller than the second amount. In other words, the control unit 38 may set a larger blowing amount when the value of the first transportation time is equal to or less than the first transportation threshold value than when the value of the first transportation time is greater than the first transportation threshold value.

For example, if the medium 17 has hygroscopic property, the medium 17 absorbs water vapor contained in air. The medium 17 absorbs a larger amount of water vapor and is therefore harder to dry when the amount of water vapor contained in air is large than when the amount of water vapor contained in air is small.

The control unit 38 may set a larger blowing amount when the value of the humidity is equal to or greater than the humidity threshold value than when the value of the humidity is less than the humidity threshold value. The control unit 38 may set a larger blowing amount when the value of the temperature is equal to or greater than the temperature threshold value than when the value of the temperature is less than the temperature threshold value. The control unit 38 may, based on the ambient temperature and ambient humidity of the site where the post-processing apparatus 14 is installed, change the blowing amount at which the blower unit 32 blows air when the second medium 17*b* is ejected from the first ejection unit 23.

If the value of the temperature is equal to or greater than the temperature threshold value and further if the value of the humidity is equal to or greater than the humidity threshold value, the control unit 38 causes the blower unit 32 to blow air at the second amount, which is the largest amount. If the value of the temperature is equal to or greater than the temperature threshold value and further if the value of the humidity is less than the humidity threshold value, the control unit 38 causes the blower unit 32 to blow air at the third amount. If the value of the temperature is less than the temperature threshold value and further if the value of the humidity is equal to or greater than the humidity threshold value, the control unit 38 causes the blower unit 32 to blow air at the third amount. The third amount is smaller than the second amount. If the value of the temperature is less than the temperature threshold value and further if the value of the humidity is less than the humidity threshold value, the control unit 38 causes the blower unit 32 to blow air at the first amount, which is smaller than the third amount.

The control unit 38 may cause the transportation unit 31 to be located at the transportation position TP when the first ejection unit 23 ejects the second medium 17*b*. The transportation unit 31, when located at the transportation position TP, nips the first medium 17*a* between itself and the processing tray 24. Therefore, even when the blown air hits the first medium 17*a*, which has already been aligned, it is possible to facilitate the drying of the first medium 17*a* while preventing the first medium 17*a* from being brought out of alignment.

The blades 36 of the paddle 29 that is in a stopped positional state are located above the position between the pair of rollers of the first ejection unit 23 configured to eject the second medium 17*b*. Therefore, the second medium 17*b* ejected from the first ejection unit 23 goes into a space between the blades 36 and the processing tray 24.

The control unit 38 may determine that the second medium 17*b* has now passed through the first ejection unit 23 upon, for example, switching from a state in which the detection unit 28 detects the second medium 17*b* to a state in which the detection unit 28 does not detect the second medium 17*b*. Upon the passing of the rear edge of the second medium 17*b* in the first ejection direction D1 through the first ejection unit 23, the control unit 38 controls the blower unit 32 and causes it to stop blowing operation.

The control unit 38 causes the transportation unit 31 to move to the waiting position WP and causes the paddle 29 to rotate counterclockwise in FIG. 2. The paddle 29 that is rotating guides the second medium 17*b* into a gap between the transportation unit 31 that is located at the waiting position WP and the processing tray 24.

Next, the control unit 38 causes the transportation unit 31 to move to the transportation position TP. The transportation unit 31 located at the transportation position TP is in contact with the upper surface of the second medium 17*b* on the processing tray 24. The control unit 38 aligns the second medium 17*b* by causing the transportation unit 31 located at the transportation position TP to rotate. In the present embodiment, the medium 17 before alignment is referred to as the second medium 17*b*, and the medium 17 after alignment is referred to as the first medium 17*a*. Therefore, aligned sheets of the first medium 17*a* are stacked on the processing tray 24.

If the number of sheets of the first medium 17*a* stacked on the processing tray 24 is less than the processing-specified number of sheets, which is the number of sheets having been specified as a unit of post-processing execution, the control unit 38 waits until the first ejection unit 23 ejects the next sheet of the second medium 17*b*.

If the first transportation time of the next sheet of the second medium 17*b* is predicted to be equal to or greater than the second transportation threshold value, the control unit 38 may cause the blower unit 32 to blow air before the second medium 17*b* reaches the first ejection unit 23. The blowing amount in this blowing operation may be, for example, the second amount. Upon detecting the leading edge of the second medium 17*b* by the detection unit 28, the control unit 38 may adjust the blowing amount into an amount that is suited for the state of the first medium 17*a* and the second medium 17*b*. Therefore, the control unit 38 may cause the blower unit 32 to blow air until the second medium 17*b* is ejected from the first ejection unit 23 upon the lapse of the first transportation time.

When the number of sheets stacked on the processing tray 24 has reached the processing-specified number of sheets, the control unit 38 causes the post-processing apparatus 14 to perform post processing. The post-processing unit 33 according to the present embodiment binds plural sheets of the first medium 17*a* stacked on the processing tray 24 together with a staple. The control unit 38 controls the second ejection unit 25 and causes it to eject the staple-bound sheets of the first medium 17*a* on the processing tray 24 to the stacking tray 26. When this ejection operation is performed, the blower unit 32 blows air to the medium 17 ejected by the second ejection unit 25. The control unit 38 causes the blower unit 32 to blow air at a blowing amount that is suited for the state of the first medium 17*a* and the third medium 17*c*.

Specifically, if the third sum calculated by adding together the third upper-surface recording density of the upper surface of the third medium 17*c*, and the first lower-surface recording density of the lower surface of the first medium 17*a*, is less than the third sum threshold value, the control unit 38 sets the blowing amount into the first amount. The first amount set when the first medium 17*a* is ejected from the second ejection unit 25 may be the same as the first amount set when the second medium 17*b* is ejected from the first ejection unit 23, or may be different therefrom.

If the third sum is equal to or greater than the third sum threshold value, the control unit 38 sets the blowing amount into the second amount that is larger than the first amount. The second amount set when the first medium 17*a* is ejected from the second ejection unit 25 may be the same as the second amount set when the second medium 17*b* is ejected from the first ejection unit 23, or may be different therefrom.

The control unit 38 may change the blowing amount in accordance with the number of sheets of the first medium 17*a* stacked on the processing tray 24. The second ejection unit 25 according to the present embodiment ejects a plurality of post-processed sheets of the first medium 17*a* together. Therefore, the number of sheets of the first medium 17*a* ejected by the second ejection unit 25 is equal to the number of sheets post-processed by the post-processing unit 33. The control unit 38 may set a larger blowing amount when the number of sheets stacked thereon is equal to or greater than the number-of-sheets threshold value than when the number of sheets stacked thereon is less than the number-of-sheets threshold value. For example, if the number of sheets stacked thereon is less than the number-of-sheets threshold value, the control unit 38 causes the blower unit 32 to blow air at the first amount. If the number of sheets stacked thereon is equal to or greater than the number-of-sheets threshold value, the control unit 38 causes the blower unit 32 to blow air at the second amount that is larger than the first amount. The blower unit 32 blows air to the upper surface of the top one of the plurality of sheets of the first medium 17*a*, thereby preventing the dilation of the plurality of sheets of the first medium 17*a*.

The control unit 38 may change the blowing amount in accordance with the length of the second transportation time from performing recording on the bottom one of the plurality of sheets of the first medium 17*a* by the recording unit 21 to ejecting these sheets of the first medium 17*a* by the second ejection unit 25. The control unit 38 may set a larger blowing amount when the value of the second transportation time is equal to or less than the third transportation threshold value than when the value of the second transportation time is greater than the third transportation threshold value.

If the second transportation time is long, the drying of the third medium 17*c* progresses before the first medium 17*a* is ejected, and, because of this drying, frictional force that acts between the first medium 17*a* and the third medium 17*c* decreases in some instances. Therefore, the control unit 38 may cause the blower unit 32 to blow air at the second amount when the value of the second transportation time is equal to or less than the third transportation threshold value and may cause the blower unit 32 to blow air at the first amount or at the third amount when the value of the second transportation time is greater than the third transportation threshold value. The third amount is larger than the first amount and is smaller than the second amount. The third amount set when the first medium 17*a* is ejected from the second ejection unit 25 may be the same as the third amount set when the second medium 17*b* is ejected from the first ejection unit 23, or may be different therefrom.

The control unit 38 may change the blowing amount in accordance with temperature and humidity also when the first medium 17*a* is ejected from the second ejection unit 25, as done so when the second medium 17*b* is ejected from the first ejection unit 23. The control unit 38 may set a larger blowing amount when the value of the humidity is equal to or greater than the humidity threshold value than when the value of the humidity is less than the humidity threshold value. The control unit 38 may set a larger blowing amount when the value of the temperature is equal to or greater than the temperature threshold value than when the value of the temperature is less than the temperature threshold value.

Effects of First Embodiment (1) Based on processing information about processing performed on the medium 17, the control unit 38 changes the blowing amount at which the blower unit 32 blows air to the medium 17. Therefore, the blower unit 32 is able to blow air at a blowing amount that is suited for the state of the medium 17, thereby reducing the risk of buckling of the medium 17.

(2) Frictional force that acts between the first medium 17*a* and the second medium 17*b* varies depending on the respective recording densities of the two surfaces that are in contact with each other. Specifically, frictional force that acts between the first medium 17*a* and the second medium 17*b* is larger when the first sum calculated by adding the first upper-surface recording density of the first medium 17*a* and the second lower-surface recording density of the second medium 17*b* together is a large value than when the first sum is a small value. The second medium 17*b* is harder to slide on the first medium 17*a* when the frictional force is large than when the frictional force is small. Therefore, the second medium 17*b* is more susceptible to buckling when the frictional force is large than when the frictional force is small. In this respect, the control unit 38 sets a larger blowing amount when the first sum calculated by adding the first upper-surface recording density and the second lower-surface recording density together is equal to or greater than the first sum threshold value than when the first sum is less than the first sum threshold value. This makes the second medium 17*b* easier to slide on the first medium 17*a*, thereby reducing the risk of buckling of the second medium 17*b*.

(3) The medium 17 having absorbed moisture is more susceptible to flexure than the dry medium 17. The medium 17 is more likely to absorb water vapor when humidity is high than when humidity is low. In this respect, the processing information includes humidity information. The control unit 38 is able to change the blowing amount based on the humidity. Therefore, it is possible to cause the blower unit 32 to blow air at a blowing amount set in consideration of the influence of water vapor contained in air.

(4) The drying of an image printed on the medium 17 progresses while the medium 17 is transported. Therefore, if the first transportation time is short, in some instances the medium 17 is ejected from the first ejection unit 23 in an insufficiently image-dried state. The processing information includes the first transportation time. The control unit 38 is able to change the blowing amount based on the first transportation time. Therefore, it is possible to cause the blower unit 32 to blow air at a blowing amount set in consideration of the state of the drying of the medium 17.

(5) Sheets of the first medium 17*a* are stacked on the processing tray 24. Therefore, when the next sheet, the second medium 17*b*, is ejected from the first ejection unit 23, there is the first medium 17*a* on the processing tray 24. If the first transportation time is predicted to be equal to or greater than the second transportation threshold value, the control unit 38 causes the blower unit 32 to blow air. That is, the blower unit 32 blows air to the first medium 17*a* having been ejected earlier and stacked on the processing tray 24, before the second medium 17*b* coming later is ejected from the first ejection unit 23. Therefore, the blower unit 32 is able to facilitate the drying of the first medium 17*a* stacked on the processing tray 24.

(6) Frictional force that acts between the first medium 17*a* and the third medium 17*c* varies depending on the respective recording densities of the two surfaces that are in contact with each other. Specifically, frictional force that acts between the first medium 17*a* and the third medium 17*c* is larger when the third sum calculated by adding the first lower-surface recording density of the first medium 17*a* and the third upper-surface recording density of the third medium 17*c* together is a large value than when the third sum is a small value. The first medium 17*a* is harder to slide on the third medium 17*c* when the frictional force is large than when the frictional force is small. Therefore, the first medium 17*a* is more susceptible to buckling when the frictional force is large than when the frictional force is small. In this respect, the control unit 38 sets a larger blowing amount when the third sum calculated by adding the first lower-surface recording density and the third upper-surface recording density together is equal to or greater than the third sum threshold value than when the third sum is less than the third sum threshold value. This makes the first medium 17*a* easier to slide on the third medium 17*c*, thereby reducing the risk of buckling of the first medium 17*a*.

(7) The first medium 17*a* stacked on the processing tray 24 and then ejected by the second ejection unit 25 is more susceptible to buckling when the number of sheets of the first medium 17*a* is large than when the number of sheets of the first medium 17*a* is small. The processing information includes the number of sheets of the first medium 17*a*. The control unit 38 is able to cause the blower unit 32 to blow air at a blowing amount that is suited for the state of the first medium 17*a* stacked on the processing tray 24.

(8) When the second ejection unit 25 ejects the first medium 17*a*, on the stacking tray 26, there is the third medium 17*c* having been ejected earlier from the second ejection unit 25. The drying of the third medium 17*c* having been stacked on the stacking tray 26 progresses while waiting for the ejection of the next first medium 17*a*. Therefore, if the second transportation time till the ejection of the next first medium 17*a* is short, in some instances the next first medium 17*a* is ejected in a state in which the drying of the third medium 17*c* having been ejected earlier is insufficient. The first medium 17*a* ejected later is harder to slide on the third medium 17*c* having been ejected earlier if the drying of the third medium 17*c* is insufficient. Unsmooth sliding makes the medium 17 ejected later more susceptible to buckling. In this respect, the control unit 38 sets a larger blowing amount when the value of the second transportation time is equal to or less than the third transportation threshold value than when the value of the second transportation time is greater than the third transportation threshold value. This makes the first medium 17*a* easier to move, thereby reducing the risk of buckling of the first medium 17*a*.

Second Embodiment

Next, with reference to the accompanying drawings, a post-processing apparatus according to a second embodiment will now be explained. The second embodiment is different from the first embodiment in its first ejection sub-routine. Except for this difference, the second embodiment is almost the same as the first embodiment. Therefore, the same reference numerals are assigned to the same parts of the configuration, and an explanation of the same parts is omitted.

Processing Information

The processing information may include a density difference that is a difference between the second upper-surface recording density of the upper surface of the second medium 17*b*, and the second lower-surface recording density of the lower surface of the second medium 17*b*.

First Ejection Sub-Routine According to Second Embodiment

Next, with reference to the flowchart of FIG. 6, the first ejection sub-routine according to the second embodiment will now be explained. A density difference threshold value used for comparison in the first ejection sub-routine has been set in advance based on, for example, the result of an experiment.

Figure 3:
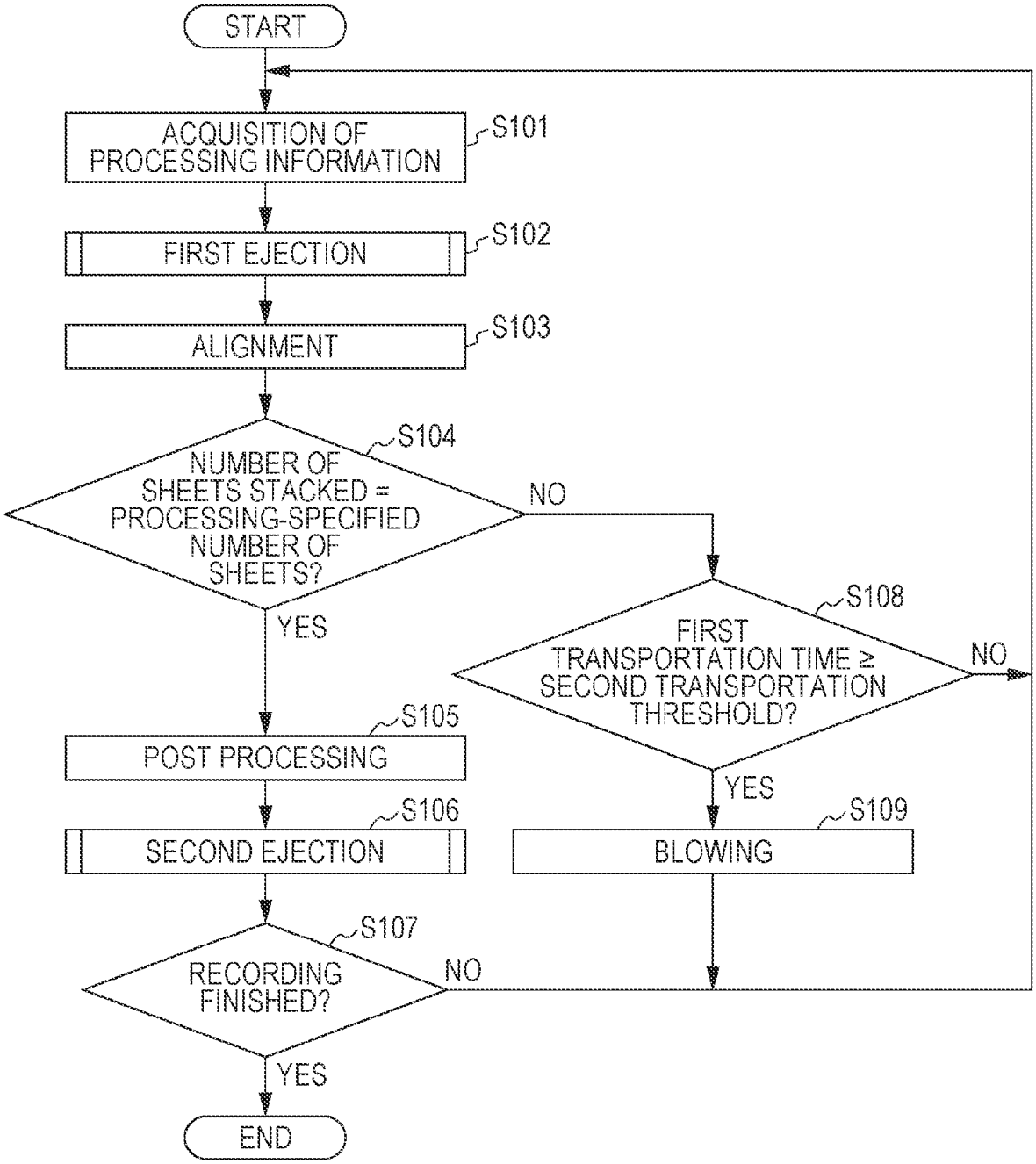
FIG. 3 is a flowchart that illustrates an alignment routine according to the first embodiment.

The first ejection sub-routine is executed in the step S102 of the alignment routine illustrated in FIG. 3. In the second embodiment, a density difference is also acquired by the control unit 38 as an item of the processing information in the step S101 of the alignment routine.

Figure 6:
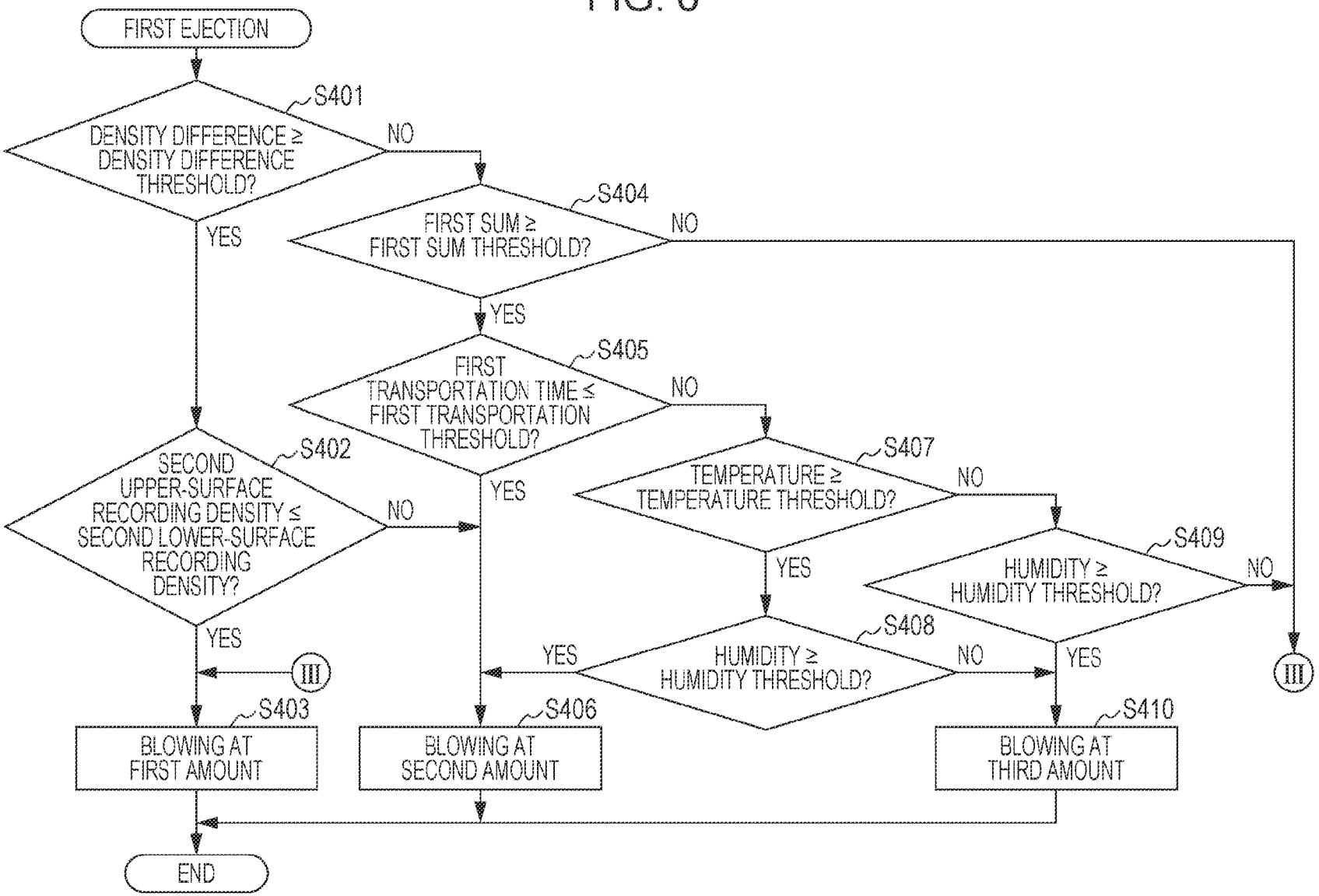
FIG. 6 is a flowchart that illustrates a first ejection sub-routine according to a second embodiment.

As illustrated in FIG. 6, in a step S401, the control unit 38 compares the density difference, which is a difference between the second upper-surface recording density of the second medium 17*b* and the second lower-surface recording density of the second medium 17*b*, with the density difference threshold value.

If the density difference is equal to or greater than the density difference threshold value, the determination result of the step S401 is YES. In this case, the control unit 38 advances the process to a step S402. In the step S402, the control unit 38 compares the second upper-surface recording density of the second medium 17*b* with the second lower-surface recording density of the second medium 17*b*. If the value of the second upper-surface recording density is equal to or less than the value of the second lower-surface recording density, the determination result of the step S402 is YES. In this case, the control unit 38 advances the process to a step S403. In the step S403, the control unit 38 controls the blower unit 32 and causes it to blow air at a first amount of blow.

If the value of the second upper-surface recording density is greater than the value of the second lower-surface recording density, the determination result of the step S402 is NO. In this case, the control unit 38 advances the process to a step S406. In the step S406, the control unit 38 controls the blower unit 32 and causes it to blow air at a second amount of blow that is larger than the first amount of blow.

Referring back to the step S401, if the density difference is less than the density difference threshold value, the determination result of the step S401 is NO. In this case, the control unit 38 advances the process to a step S404. In the step S404, the control unit 38 compares the first sum calculated by adding together the first upper-surface recording density of the upper surface of the first medium 17*a*, and the second lower-surface recording density of the lower surface of the second medium 17*b*, with the first sum threshold value. If the first sum is less than the first sum threshold value, the determination result of the step S404 is NO. In this case, the control unit 38 advances the process to the step S403.

If the first sum is equal to or greater than the first sum threshold value, the determination result of the step S404 is YES. In this case, the control unit 38 advances the process to a step S405.

The steps S405 to S410 are the same as the steps S203 to S208 illustrated in FIG. 4. Therefore, an explanation of these steps is omitted here.

Operation of Second Embodiment

In accordance with the recording densities of the second medium 17*b*, the control unit 38 changes the blowing amount at which the blower unit 32 blows air when the second medium 17*b* is ejected from the first ejection unit 23.

The control unit 38 sets the blowing amount into the first amount when the second lower-surface recording density of the lower surface of the second medium 17*b* is higher than the second upper-surface recording density of the upper surface of the second medium 17*b* by the density difference equal to or greater than the density difference threshold value. That is, when the density difference, which is the difference between the second upper-surface recording density of the upper surface of the second medium 17*b* and the second lower-surface recording density of the lower surface of the second medium 17*b*, is equal to or greater than the density difference threshold value and further when the value of the second upper-surface recording density is equal to or less than the value of the second lower-surface recording density, the control unit 38 sets the blowing amount into the first amount.

The control unit 38 sets the blowing amount into the second amount that is larger than the first amount when the second upper-surface recording density is higher than the second lower-surface recording density by the density difference equal to or greater than the density difference threshold value. That is, when the density difference between the second upper-surface recording density and the second lower-surface recording density is equal to or greater than the density difference threshold value and further when the second upper-surface recording density is higher than the second lower-surface recording density, the control unit 38 sets the blowing amount into the second amount.

If the density difference between the second upper-surface recording density and the second lower-surface recording density is less than the density difference threshold value, the control unit 38 adjusts the blowing amount in accordance with the first sum that is a sum of the first upper-surface recording density of the upper surface of the first medium 17*a* and the second lower-surface recording density of the lower surface of the second medium 17*b*. The control unit 38 sets the blowing amount into the first amount when the first sum is less than the first sum threshold value. The control unit 38 sets the blowing amount into the second amount when the first sum is equal to or greater than the first sum threshold value.

Effects of Second Embodiment (9) When the second lower-surface recording density is higher than the second upper-surface recording density by the density difference equal to or greater than the density difference threshold value, the second medium 17*b* is prone to becoming curled up in a rising manner. When the second upper-surface recording density is higher than the second lower-surface recording density by the density difference equal to or greater than the density difference threshold value, the second medium 17*b* is prone to becoming curled in a drooping manner. The control unit 38 sets a larger blowing amount when the second upper-surface recording density is higher than the second lower-surface recording density by the density difference equal to or greater than the density difference threshold value. Therefore, it is possible to support the second medium 17*b* curled in a drooping manner by the air blown, thereby reducing the risk of buckling of the second medium 17*b* caused by hitting against the first medium 17*a*.

(10) It is less likely that the curl of the second medium 17*b* grows larger when the density difference that is a difference between the second upper-surface recording density and the second lower-surface recording density is less than the density difference threshold value, as compared with a case where the density difference is equal to or greater than the density difference threshold value. However, frictional force that acts between the first medium 17*a* and the second medium 17*b* is larger when the first sum is a large value than when the first sum is a small value. In this respect, even when the density difference between the second upper-surface recording density and the second lower-surface recording density is less than the density difference threshold value, the control unit 38 sets a larger blowing amount if the first sum calculated by adding the first upper-surface recording density and the second lower-surface recording density together is equal to or greater than the first sum threshold value. This makes the second medium 17*b* easier to slide on the first medium 17*a*, thereby reducing the risk of buckling of the second medium 17*b*.

Third Embodiment

Next, with reference to the accompanying drawings, a post-processing apparatus according to a third embodiment will now be explained. The third embodiment is different from the first embodiment and the second embodiment in its part of the first ejection sub-routine. Except for this difference, the third embodiment is almost the same as the first embodiment and the second embodiment. Therefore, the same reference numerals are assigned to the same parts of the configuration, and an explanation of the same parts is omitted.

Processing Information

The processing information may include a second sum that is a sum of the second upper-surface recording density of the upper surface of the second medium 17*b* and the second lower-surface recording density of the lower surface of the second medium 17*b*.

First Ejection Sub-Routine According to Third Embodiment

Next, with reference to the flowchart of FIG. 7, the first ejection sub-routine according to the third embodiment will now be explained. A second sum threshold value used for comparison in the first ejection sub-routine has been set in advance based on, for example, the result of an experiment.

The first ejection sub-routine is executed in the step S102 of the alignment routine illustrated in FIG. 3. In the third embodiment, a second sum is also acquired by the control unit 38 as an item of the processing information in the step S101 of the alignment routine.

Figure 7:
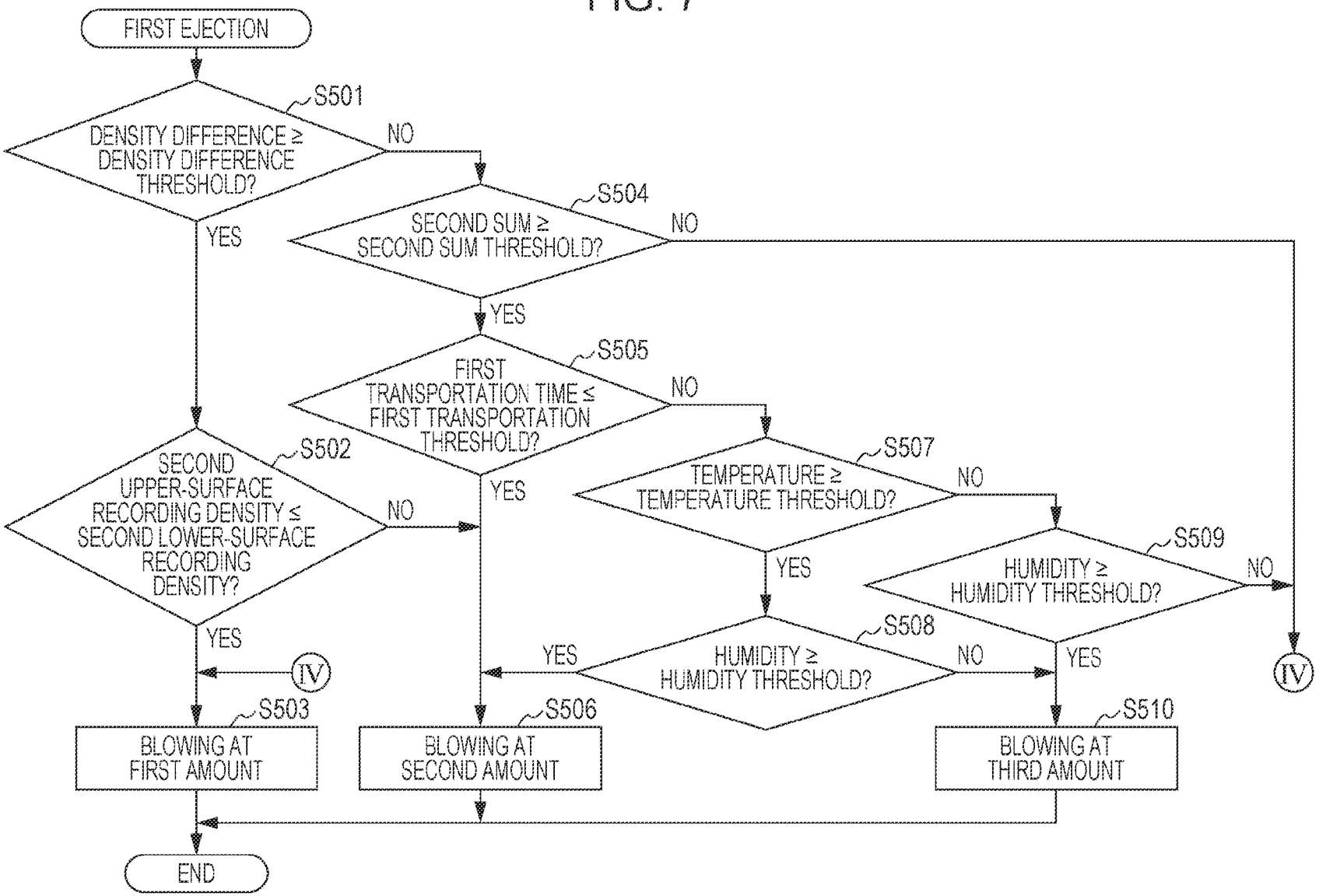
FIG. 7 is a flowchart that illustrates a first ejection sub-routine according to a third embodiment.

As illustrated in FIG. 7, the steps S501 to S503 are the same as the steps S401 to S403 illustrated in FIG. 6. Therefore, an explanation of these steps is omitted here.

In a step S504, the control unit 38 compares the second sum calculated by adding together the second upper-surface recording density of the upper surface of the second medium 17*b*, and the second lower-surface recording density of the lower surface of the second medium 17*b*, with the second sum threshold value. If the second sum is less than the second sum threshold value, the determination result of the step S504 is NO. In this case, the control unit 38 advances the process to the step S503.

If the second sum is equal to or greater than the second sum threshold value, the determination result of the step S504 is YES. In this case, the control unit 38 advances the process to a step S505.

The steps S505 to S510 are the same as the steps S203 to S208 illustrated in FIG. 4. Therefore, an explanation of these steps is omitted here.

Operation of Third Embodiment

In accordance with the recording densities of the second medium 17*b*, the control unit 38 changes the blowing amount at which the blower unit 32 blows air when the second medium 17*b* is ejected from the first ejection unit 23.

If the density difference between the second upper-surface recording density and the second lower-surface recording density is less than the density difference threshold value, the control unit 38 adjusts the blowing amount in accordance with the second sum that is a sum of the second upper-surface recording density of the upper surface of the second medium 17*b* and the second lower-surface recording density of the lower surface of the second medium 17*b*. The control unit 38 sets the blowing amount into the first amount when the second sum is less than the second sum threshold value. The control unit 38 sets the blowing amount into the second amount when the second sum is equal to or greater than the second sum threshold value.

Effects of Third Embodiment

(11) The second medium 17*b* is more likely to droop when the second sum that is a sum of the second upper-surface recording density and the second lower-surface recording density is a large value than when the second sum is a small value. In this respect, even when the density difference between the second upper-surface recording density and the second lower-surface recording density is equal to or less than the density difference threshold value, the control unit 38 sets the blowing amount into the second amount if the second sum is equal to or greater than the second sum threshold value. Therefore, it is possible to support the second medium 17*b* that droops by the air blown, thereby reducing the risk of buckling of the second medium 17*b* caused by hitting against the first medium 17*a*.

The foregoing embodiments may be modified as described below. The foregoing embodiments and the following modification examples may be combined with one another as long as they are not technically contradictory to one another.

The processing information may include thickness information, which is information about the thickness of the medium 17. The thickness information may be a numerical value that indicates the degree of thickness of the medium 17. The thickness information may be the basis weight of the medium 17. The control unit 38 may set a larger blowing amount when the medium 17 is thin than when the medium 17 is thick.

The processing information may include the direction of texture of the medium 17. The direction of texture means the orientation of fibers constituting the medium 17. The control unit 38 may set a larger blowing amount when the direction of texture disagrees with the first ejection direction D1 than when the direction of texture agrees with the first ejection direction D1.

The processing information may include size information, which is information about the size of the medium 17. The size information may be information about either the vertical size or the horizontal size, or both, of the medium 17. The size information may be information about standard size such as A4, A3, etc. The control unit 38 may change the blowing amount in accordance with the size. For example, the control unit 38 may set a larger blowing amount when the size of the medium 17 is large than when the size of the medium 17 is small.

The processing information may include resolution information, which is information about the resolution of an image that is printed. The size of each liquid droplet ejected by the recording unit 21 is larger when the resolution is high than when the resolution is low. In addition, the number of liquid droplets ejected by the recording unit 21 is larger when the resolution is high than when the resolution is low. For this reason, higher resolution makes recording time required for recording longer and thus makes it possible to make transportation time longer in accordance with the longer recording time. Therefore, the control unit 38 may set a larger blowing amount when the resolution is low and the transportation time is thus short than when the resolution is high and the transportation time is thus long.

The processing information may include water vapor amount information, which is information about the amount of water vapor contained in air. "Water vapor amount" is the amount of water vapor per unit volume. The control unit 38 may set a larger blowing amount when the amount of water vapor contained in air is equal to or larger than a water vapor threshold than when the amount of water vapor is smaller than the water vapor threshold. The control unit 38 may calculate the amount of water vapor from humidity. The control unit 38 may calculate the amount of water vapor from temperature and humidity. The water vapor threshold may be a value calculated from the humidity threshold value and the temperature threshold value.

The control unit 38 may change the blowing amount based on at least one of the following parameters: the first upper-surface recording density, the first lower-surface recording density, the second upper-surface recording density, the second lower-surface recording density, the third upper-surface recording density, the third lower-surface recording density, the number of sheets stacked, humidity, temperature, the first transportation time, and the second transportation time.

The control unit 38 may take temperature out of consideration when adjusting the change amount based on humidity.

The control unit 38 may store a plurality of humidity threshold values. The control unit 38 may store a plurality of temperature threshold values.

The control unit 38 may cause the blower unit 32 to start blowing operation irrespective of the first transportation time of the next sheet of the second medium 17*b* after the alignment of the second medium 17*b*. The control unit 38 may cause the blower unit 32 to start blowing operation irrespective of the first transportation time of the next sheet of the second medium 17*b* after causing the transportation unit 31 located at the waiting position WP to move to the transportation position TP. That is, the control unit 38 may cause the blower unit 32 to blow air to the second medium 17*b* that is aligned. The control unit 38 may adjust the blowing amount at the timing of arrival of the next sheet of the second medium 17*b* at the first ejection unit 23. The control unit 38 may cause the blower unit 32 to temporarily stop blowing operation before the arrival of the next sheet of the second medium 17*b* at the first ejection unit 23.

Any kind of liquid may be chosen as long as it is possible to perform recording on the medium 17 by adhesion of the liquid to the medium 17. For example, the liquid may be ink; "ink" encompasses a substance that is made as a result of dissolution, dispersion, or mixture of particles of a functional material made of a solid such as pigment, metal particles, or the like into/with a solvent, and encompasses various kinds of liquid composition such as water-based ink, oil-based ink, gel ink, hot melt ink, and the like.

Technical concepts that will be understood from the foregoing embodiments and modification examples, and the operational effects thereof, are described below.

(A) A post-processing apparatus includes: an ejection unit that ejects a medium recorded by a recording unit configured to perform recording by ejecting a liquid; a processing tray on which the medium ejected by the ejection unit is stacked; a blower unit that blows air to the medium stacked on the processing tray; a control unit that controls the blower unit; and a post-processing unit that post-processes the medium stacked on the processing tray; wherein based on processing information about processing performed on the medium, the control unit changes a blowing amount at which the blower unit blows air.

In this configuration, based on processing information about processing performed on the medium, the control unit changes the blowing amount at which the blower unit blows air to the medium. Therefore, the blower unit is able to blow air at a blowing amount that is suited for the state of the medium, thereby reducing the risk of buckling of the medium.

(B) In the above post-processing apparatus, the processing information may include a first sum that is a sum of a first upper-surface recording density of an upper surface of a first medium stacked on the processing tray and a second lower-surface recording density of a lower surface of a second medium ejected to the processing tray by the ejection unit next after the first medium, the control unit may set the blowing amount into a first amount when the first sum is less than a first sum threshold value, and the control unit may set the blowing amount into a second amount that is larger than the first amount when the first sum is equal to or greater than the first sum threshold value.

Frictional force that acts between the first medium and the second medium varies depending on the respective recording densities of the two surfaces that are in contact with each other. Specifically, frictional force that acts between the first medium and the second medium is larger when the first sum calculated by adding the first upper-surface recording density of the first medium and the second lower-surface recording density of the second medium together is a large value than when the first sum is a small value. The second medium is harder to slide on the first medium when the frictional force is large than when the frictional force is small. Therefore, the second medium is more susceptible to buckling when the frictional force is large than when the frictional force is small. In this respect, in this configuration, the control unit sets a larger blowing amount when the first sum calculated by adding the first upper-surface recording density and the second lower-surface recording density together is equal to or greater than the first sum threshold value than when the first sum is less than the first sum threshold value. This makes the second medium easier to slide on the first medium, thereby reducing the risk of buckling of the second medium.

(C) In the above post-processing apparatus, the processing information may include a second upper-surface recording density of an upper surface of a second medium ejected by the ejection unit and a second lower-surface recording density of a lower surface of the second medium, the control unit may set the blowing amount into a first amount when the second lower-surface recording density is higher than the second upper-surface recording density by a difference equal to or greater than a density difference threshold value, and the control unit may set the blowing amount into a second amount that is larger than the first amount when the second upper-surface recording density is higher than the second lower-surface recording density by a difference equal to or greater than the density difference threshold value.

When the second lower-surface recording density is higher than the second upper-surface recording density by the difference equal to or greater than the density difference threshold value, the second medium is prone to becoming curled up in a rising manner. When the second upper-surface recording density is higher than the second lower-surface recording density by the difference equal to or greater than the density difference threshold value, the second medium is prone to becoming curled in a drooping manner. In this configuration, the control unit sets a larger blowing amount when the second upper-surface recording density is higher than the second lower-surface recording density by the difference equal to or greater than the density difference threshold value. Therefore, it is possible to support the second medium curled in a drooping manner by the air blown, thereby reducing the risk of buckling of the second medium caused by hitting against the first medium.

(D) In the above post-processing apparatus, the processing information may include a first sum that is a sum of a first upper-surface recording density of an upper surface of a first medium stacked on the processing tray and the second lower-surface recording density, and the control unit may set the blowing amount into the second amount when the difference between the second upper-surface recording density and the second lower-surface recording density is less than the density difference threshold value and further when the first sum is equal to or greater than a first sum threshold value.

It is less likely that the curl of the second medium grows larger when a difference between the second upper-surface recording density and the second lower-surface recording density is less than the density difference threshold value, as compared with a case where the difference is equal to or greater than the density difference threshold value. However, frictional force that acts between the first medium and the second medium is larger when the first sum is a large value than when the first sum is a small value. In this respect, in this configuration, even when the difference between the second upper-surface recording density and the second lower-surface recording density is less than the density difference threshold value, the control unit sets a larger blowing amount if the first sum calculated by adding the first upper-surface recording density and the second lower-surface recording density together is equal to or greater than the first sum threshold value. This makes the second medium easier to slide on the first medium, thereby reducing the risk of buckling of the second medium.

(E) In the above post-processing apparatus, the processing information may include a second sum that is a sum of the second upper-surface recording density and the second lower-surface recording density, the control unit may set the blowing amount into the first amount when the difference between the second upper-surface recording density and the second lower-surface recording density is less than the density difference threshold value and further when the second sum is less than a second sum threshold value, and the control unit may set the blowing amount into the second amount when the difference between the second upper-surface recording density and the second lower-surface recording density is less than the density difference threshold value and further when the second sum is equal to or greater than the second sum threshold value.

The second medium is more likely to droop when the second sum that is a sum of the second upper-surface recording density and the second lower-surface recording density is a large value than when the second sum is a small value. In this respect, in this configuration, even when the difference between the second upper-surface recording density and the second lower-surface recording density is equal to or less than the density difference threshold value, the control unit sets the blowing amount into the second amount if the second sum is equal to or greater than the second sum threshold value. Therefore, it is possible to support the second medium that droops by the air blown, thereby reducing the risk of buckling of the second medium caused by hitting against the first medium.

(F) In the above post-processing apparatus, the processing information may include humidity information about humidity, and the control unit may set a larger amount as the blowing amount when a value of the humidity is equal to or greater than a humidity threshold value than when the value of the humidity is less than the humidity threshold value.

A medium having absorbed moisture is more susceptible to flexure than a dry medium. A medium is more likely to absorb water vapor when humidity is high than when humidity is low. In this respect, in this configuration, the processing information includes humidity information. The control unit is able to change the blowing amount based on the humidity. Therefore, it is possible to cause the blower unit to blow air at a blowing amount set in consideration of the influence of water vapor contained in air.

(G) In the above post-processing apparatus, the processing information may include first transportation time that is time from performing recording on the medium by the recording unit to ejecting the medium by the ejection unit, and the control unit may set a larger amount as the blowing amount when a value of the first transportation time is equal to or less than a first transportation threshold value than when the value of the first transportation time is greater than the first transportation threshold value.

The drying of an image printed on a medium progresses while the medium is transported. Therefore, if the first transportation time is short, in some instances the medium is ejected from the first ejection unit in an insufficiently image-dried state. In this configuration, the processing information includes the first transportation time. The control unit is able to change the blowing amount based on the first transportation time. Therefore, it is possible to cause the blower unit to blow air at a blowing amount set in consideration of the state of the drying of the medium.

(H) In the above post-processing apparatus, the processing information may include first transportation time that is time from performing recording on the medium by the recording unit to ejecting the medium by the ejection unit, and the control unit may cause the blower unit to blow air until the medium is ejected from the ejection unit upon a lapse of the first transportation time when the first transportation time is predicted to be equal to or greater than a second transportation threshold value.

Sheets of a medium are stacked on the processing tray. Therefore, when the next sheet of the medium is ejected from the ejection unit, there is the medium having been ejected earlier on the processing tray. In this configuration, if the first transportation time is predicted to be equal to or greater than the second transportation threshold value, the control unit causes the blower unit to blow air. That is, the blower unit blows air to the medium having been ejected earlier and stacked on the processing tray, before the medium coming later is ejected from the ejection unit. Therefore, the blower unit is able to facilitate the drying of the medium stacked on the processing tray.

(I) A post-processing apparatus includes: a first ejection unit that ejects a medium recorded by a recording unit configured to perform recording by ejecting a liquid; a processing tray on which the medium ejected by the first ejection unit is stacked; a post-processing unit that post-processes the medium on the processing tray; a second ejection unit that ejects the medium stacked on the processing tray; a blower unit that blows air to the medium ejected by the second ejection unit; a control unit that controls the blower unit; and a stacking tray on which the medium ejected by the second ejection unit is stacked; wherein based on processing information about processing performed on the medium, the control unit changes a blowing amount at which the blower unit blows air.

With this configuration, it is possible to produce the same effects as those of the above post-processing apparatus.

(J) In the above post-processing apparatus, the processing information may include a third sum that is a sum of a third upper-surface recording density of an upper surface of a third medium stacked on the stacking tray and a first lower-surface recording density of a lower surface of a first medium ejected by the second ejection unit, the control unit may set the blowing amount into a first amount when the third sum is less than a third sum threshold value, and the control unit may set the blowing amount into a second amount that is larger than the first amount when the third sum is equal to or greater than the third sum threshold value.

Frictional force that acts between the first medium and the third medium varies depending on the respective recording densities of the two surfaces that are in contact with each other. Specifically, frictional force that acts between the first medium and the third medium is larger when the third sum calculated by adding the first lower-surface recording density of the first medium and the third upper-surface recording density of the third medium together is a large value than when the third sum is a small value. The first medium is harder to slide on the third medium when the frictional force is large than when the frictional force is small. Therefore, the first medium is more susceptible to buckling when the frictional force is large than when the frictional force is small. In this respect, in this configuration, the control unit sets a larger blowing amount when the third sum calculated by adding the first lower-surface recording density and the third upper-surface recording density together is equal to or greater than the third sum threshold value than when the third sum is less than the third sum threshold value. This makes the first medium easier to slide on the third medium, thereby reducing the risk of buckling of the first medium.

(K) In the above post-processing apparatus, the processing information may include a number of sheets of the first medium ejected by the second ejection unit, and the control unit may set a larger amount as the blowing amount when the number of sheets is equal to or greater than a number-of-sheets threshold value than when the number of sheets is less than the number-of-sheets threshold value.

The first medium stacked on the processing tray and then ejected by the second ejection unit is more susceptible to buckling when the number of sheets of the first medium is large than when the number of sheets of the first medium is small. In this configuration, the processing information includes the number of sheets of the first medium. The control unit is able to cause the blower unit to blow air at a blowing amount that is suited for the state of the first medium stacked on the processing tray.

(L) In the above post-processing apparatus, the processing information may include humidity information about humidity, and the control unit may set a larger amount as the blowing amount when a value of the humidity is equal to or greater than a humidity threshold value than when the value of the humidity is less than the humidity threshold value.

With this configuration, it is possible to produce the same effects as those of the above post-processing apparatus.

(M) In the above post-processing apparatus, the processing information may include second transportation time that is time from performing recording on the medium by the recording unit to ejecting the medium by the second ejection unit, and the control unit may set a larger amount as the blowing amount when a value of the second transportation time is equal to or less than a third transportation threshold value than when the value of the second transportation time is greater than the third transportation threshold value.

When the second ejection unit ejects the medium, on the stacking tray, there is the medium having been ejected earlier from the second ejection unit. The drying of the medium having been stacked on the stacking tray progresses while waiting for the ejection of the next medium. Therefore, if the second transportation time till the ejection of the next medium is short, in some instances the next medium is ejected in a state in which the drying of the medium having been ejected earlier is insufficient. The medium ejected later is harder to slide on the medium having been ejected earlier if the drying of the medium having been ejected earlier is insufficient. Unsmooth sliding makes the medium ejected later more susceptible to buckling. In this respect, in this configuration, the control unit sets a larger blowing amount when the value of the second transportation time is equal to or less than the third transportation threshold value than when the value of the second transportation time is greater than the third transportation threshold value. This makes the medium easier to move, thereby reducing the risk of buckling of the medium.

What is claimed is:

1. A post-processing apparatus, comprising:

an ejection unit that ejects a medium recorded by ejection of a liquid;

a processing tray on which the medium ejected by the ejection unit is stacked;

a blower unit that blows air to the medium stacked on the processing tray;

a control unit that controls the blower unit; and a post-processing unit that post-processes the medium stacked on the processing tray; wherein based on processing information about processing performed on the medium, the control unit changes a blowing amount at which the blower unit blows air.

2. The post-processing apparatus according to claim 1, wherein the processing information includes a first sum that is a sum of a first upper-surface recording density of an upper surface of a first medium stacked on the processing tray and a second lower-surface recording density of a lower surface of a second medium ejected to the processing tray by the ejection unit next after the first medium, the control unit sets the blowing amount into a first amount when the first sum is less than a first sum threshold value, and the control unit sets the blowing amount into a second amount that is larger than the first amount when the first sum is equal to or greater than the first sum threshold value.

3. The post-processing apparatus according to claim 1, wherein the processing information includes a second upper-surface recording density of an upper surface of a second medium ejected by the ejection unit and a second lower-surface recording density of a lower surface of the second medium, the control unit sets the blowing amount into a first amount when the second lower-surface recording density is higher than the second upper-surface recording density by a difference equal to or greater than a density difference threshold value, and the control unit sets the blowing amount into a second amount that is larger than the first amount when the second upper-surface recording density is higher than the second lower-surface recording density by a difference equal to or greater than the density difference threshold value.

4. The post-processing apparatus according to claim 3, wherein the processing information includes a first sum that is a sum of a first upper-surface recording density of an upper surface of a first medium stacked on the processing tray and the second lower-surface recording density, and the control unit sets the blowing amount into the second amount when the difference between the second upper-surface recording density and the second lower-surface recording density is less than the density difference threshold value and further when the first sum is equal to or greater than a first sum threshold value.

5. The post-processing apparatus according to claim 3, wherein the processing information includes a second sum that is a sum of the second upper-surface recording density and the second lower-surface recording density, the control unit sets the blowing amount into the first amount when the difference between the second upper-surface recording density and the second lower-surface recording density is less than the density difference threshold value and further when the second sum is less than a second sum threshold value, and the control unit sets the blowing amount into the second amount when the difference between the second upper-surface recording density and the second lower-surface recording density is less than the density difference threshold value and further when the second sum is equal to or greater than the second sum threshold value.

6. The post-processing apparatus according to claim 1, wherein the processing information includes humidity information about humidity, and the control unit sets a larger amount as the blowing amount when a value of the humidity is equal to or greater than a humidity threshold value than when the value of the humidity is less than the humidity threshold value.

7. The post-processing apparatus according to claim 1, wherein the processing information includes first transportation time that is time from performing recording on the medium by a recording unit to ejecting the medium by the ejection unit, and the control unit sets a larger amount as the blowing amount when a value of the first transportation time is equal to or less than a first transportation threshold value than when the value of the first transportation time is greater than the first transportation threshold value.

8. The post-processing apparatus according to claim 1, wherein the processing information includes first transportation time that is time from performing recording on the medium by a recording unit to ejecting the medium by the ejection unit, and the control unit causes the blower unit to blow air until the medium is ejected from the ejection unit upon a lapse of the first transportation time when the first transportation time is predicted to be equal to or greater than a second transportation threshold value.

9. A post-processing apparatus, comprising:

a first ejection unit that ejects a medium recorded by ejection of a liquid;

a processing tray on which the medium ejected by the first ejection unit is stacked;

a post-processing unit that post-processes the medium stacked on the processing tray;

a second ejection unit that ejects the medium stacked on the processing tray;

a blower unit that blows air to the medium ejected by the second ejection unit;

a control unit that controls the blower unit; and a stacking tray on which the medium ejected by the second ejection unit is stacked; wherein based on processing information about processing performed on the medium, the control unit changes a blowing amount at which the blower unit blows air.

10. The post-processing apparatus according to claim 9, wherein the processing information includes a third sum that is a sum of a third upper-surface recording density of an upper surface of a third medium stacked on the stacking tray and a first lower-surface recording density of a lower surface of a first medium ejected by the second ejection unit, the control unit sets the blowing amount into a first amount when the third sum is less than a third sum threshold value, and the control unit sets the blowing amount into a second amount that is larger than the first amount when the third sum is equal to or greater than the third sum threshold value.

11. The post-processing apparatus according to claim 10, wherein the processing information includes a number of sheets of the first medium ejected by the second ejection unit, and the control unit sets a larger amount as the blowing amount when the number of sheets is equal to or greater than a number-of-sheets threshold value than when the number of sheets is less than the number-of-sheets threshold value.

12. The post-processing apparatus according to claim 9, wherein the processing information includes humidity information about humidity, and the control unit sets a larger amount as the blowing amount when a value of the humidity is equal to or greater than a humidity threshold value than when the value of the humidity is less than the humidity threshold value.

13. The post-processing apparatus according to claim 9, wherein the processing information includes second transportation time that is time from performing recording on the medium by a recording unit to ejecting the medium by the second ejection unit, and the control unit sets a larger amount as the blowing amount when a value of the second transportation time is equal to or less than a third transportation threshold value than when the value of the second transportation time is greater than the third transportation threshold value.

* * * * *